US010921068B2

(12) United States Patent
Han et al.

(10) Patent No.: US 10,921,068 B2
(45) Date of Patent: Feb. 16, 2021

(54) INTEGRATED HEAT EXCHANGER

(71) Applicant: Hanon Systems, Daejeon (KR)

(72) Inventors: Ji Hun Han, Daejeon (KR); Gwang Ok Ko, Daejeon (KR); Byoung Sun Cho, Daejeon (KR); Jung bum Choi, Daejeon (KR)

(73) Assignee: Hanon Systems, Daejeon (KR)

( * ) Notice: Subject to any disclaimer, the term of this patent is extended or adjusted under 35 U.S.C. 154(b) by 57 days.

(21) Appl. No.: 16/217,692

(22) Filed: Dec. 12, 2018

(65) Prior Publication Data

US 2019/0186848 A1 Jun. 20, 2019

(30) Foreign Application Priority Data

Dec. 19, 2017 (KR) ..... 10-2017-0174867

(51) Int. Cl.

| | |
|---|---|
| ***F28F 9/02*** | (2006.01) |
| ***F28F 9/04*** | (2006.01) |
| ***F28F 1/12*** | (2006.01) |
| ***F28D 7/16*** | (2006.01) |
| ***F28D 1/053*** | (2006.01) |

(Continued)

(52) U.S. Cl.

CPC ..... *F28F 9/02* (2013.01); *F28D 1/0443* (2013.01); *F28D 1/05316* (2013.01); *F28D 7/16* (2013.01); *F28F 1/126* (2013.01); *F28F 9/0212* (2013.01); *F28F 9/0226* (2013.01); *F28F 9/04* (2013.01); *F28F 9/18* (2013.01); *F28F 1/003* (2013.01); *F28F 2265/16* (2013.01); *F28F 2270/02* (2013.01)

(58) Field of Classification Search

CPC ..... F28F 9/0219; F28F 9/0224; F28F 9/0226; F28F 2270/02; F28F 2265/16; F28D 1/0443

See application file for complete search history.

(56) References Cited

U.S. PATENT DOCUMENTS

2008/0047687 A1 2/2008 Leitch et al.
2008/0115528 A1* 5/2008 Yamamoto ..... F28D 1/0443 62/513

(Continued)

FOREIGN PATENT DOCUMENTS

CN 103874902 A 6/2014
DE 2353442 A1 4/1975

(Continued)

*Primary Examiner* — Eric S Ruppert
(74) *Attorney, Agent, or Firm* — Norton Rose Fulbright US LLP; James R. Crawford

(57) ABSTRACT

Provided is an integrated heat exchanger including a header tank in which a gasket is interposed between the header and the tank to seal a portion that the header and the tank are coupled to each other, wherein an inner space of the header tank is partitioned such that a first space portion formed between regions in which the heat exchange medium flows is formed to be in communication with an external region of the header tank through a heat exchange medium discharging means formed at a portion that the header and the tank are coupled to each other, thereby preventing the heat exchange mediums from being leaked between two heat exchange portions and to detect a leakage of the heat exchange medium even when the leakage of the heat exchange medium occurs.

15 Claims, 9 Drawing Sheets

(51) Int. Cl.

| | |
|---|---|
| ***F28F 9/18*** | (2006.01) |
| ***F28D 1/04*** | (2006.01) |
| *F28F 1/00* | (2006.01) |

(56) References Cited

U.S. PATENT DOCUMENTS

| | | | | |
|---|---|---|---|---|
| 2011/0017434 | A1* | 1/2011 | Lesueur | F28F 9/0226 165/158 |
| 2011/0168372 | A1* | 7/2011 | Takahashi | F28F 9/0226 165/173 |
| 2012/0247742 | A1* | 10/2012 | Mizuno | F28D 1/05391 165/173 |

FOREIGN PATENT DOCUMENTS

| | | | | | |
|---|---|---|---|---|---|
| FR | 2913477 | A1 | | 9/2008 | |
| JP | 2008126720 | A | | 6/2008 | |
| JP | 2013164256 | A | | 8/2013 | |
| JP | 2016102623 | A | * | 6/2016 | |
| JP | 2016200372 | A | | 12/2016 | |
| KR | 20070081635 | A | | 8/2007 | |
| WO | WO-2019054774 | A1 | * | 3/2019 | F28F 9/16 |

* cited by examiner

INTEGRATED HEAT EXCHANGER

CROSS-REFERENCE TO RELATED APPLICATIONS

This application claims priority under 35 U.S.C. § 119 to Korean Patent Application No. 10-2017-0174867, filed on Dec. 19, 2018, in the Korean Intellectual Property Office, the disclosure of which is incorporated herein by reference in its entirety.

TECHNICAL FIELD

The following disclosure relates to an integrated heat exchanger in which two heat exchanging parts are formed integrally with each other.

BACKGROUND

In general, a heat exchanger is an apparatus installed on a specific flow path to perform heat exchange in such a manner that a heat exchange medium circulating in the specific flow path absorbs heat of outside air or radiates heat of the heat exchange medium itself to the outside.

Such a heat exchanger is variously manufactured according to the purpose of use thereof such as a condenser and an evaporator using a refrigerant as a heat exchange medium, a radiator and a heater core using cooling water as the heat exchange medium, an oil cooler using oil as the heat exchange medium to cool the oil flowing in an engine and a transmission, and the like.

In addition, as the interest in the environment and energy around the world has recently increased in the automobile industry, studies are conducted to improve fuel efficiency, and in order to meet the needs of various consumers, research and development for lightening, miniaturization, and high functionalization have been conducted steadily.

In the heat exchanger used in a vehicle, however, when a plurality of heat exchangers are separately manufactured and installed, not only productivity is low due to a large number of manufacturing processes, but also the waste of materials is so severe that it is difficult to secure a space for mounting the respective heat exchangers in addition to the cost increase. Therefore, in order to solve the above-mentioned problem, various techniques for integrally forming the plurality of heat exchangers have been developed and used.

Korean Patent Laid-Open Publication No. 10-2007-0081635, which is the related art, discloses an integrated heat exchanger, and FIG. 1 is a view illustrating an integrated heat exchanger according to the related art.

As illustrated, the integrated heat exchanger according to the related art is configured to include a plurality of first tubes 11 through which a first fluid flows, a first core part 10 including a first heat radiation fin 12 interposed between the first tubes 11 and first heads 13 coupled to both ends of the first tubes 11, respectively, a plurality of second tubes 21 through which a second fluid flows, a second core part 20 including a second heat radiation fin 22 interposed between the second tubes 21 and second heads 23 coupled to both ends of the second tubes 21, respectively, a single tank 30 simultaneously coupled to the first headers 13 and the second headers 23 of the first and second core parts 10 and 20 to form a space in which the first and second fluids flow, and at least one baffle 60 installed in the tank 30 to separate the first fluid and the second fluid from each other. The integrated heat exchanger according to the related art as described above may simultaneously cool two heat exchange mediums by partitioning an inner portion of the single tank 30 with the baffle 60.

However, in such a heat exchanger, since the two heat exchange mediums having different temperatures are circulated in the single tank partitioned by the baffle 60, the tubes and the tank are deformed by a difference in thermal expansion between the tubes 11 and 21 and the tank 60 due to a temperature difference, and as a result, leakage of the heat exchange medium may occur. In order to solve such a problem, a pair of baffles 60 disposed to be spaced apart from each other is installed in the tank 30, and a heat blocking slot 31 is formed between the pair of baffles 60 to block a heat transfer of the two heat exchange mediums through the tank 30. However, there is a problem in that the heat transfer is still performed through a connection portion of the tank 30 and the leakage of the heat exchange medium may still occur. Accordingly, a leakage detection hole may be formed in the header or the tank at a position between the pair of baffles 60 to detect the leakage of the heat exchange mediums. However, external foreign materials or the like may be introduced through the leak detection hole and corrosion of a sealed portion may occur.

RELATED ART DOCUMENT

Patent Document

KR 10-2007-0081635 A (2007 Aug. 17)

SUMMARY

An embodiment of the present invention is directed to providing an integrated heat exchanger capable of preventing heat exchange mediums from being leaked between two heat exchanging parts in the integrated heat exchanger in which the two heat exchanging parts are integrally formed, and detecting the leakage of the heat exchange medium even though the leakage of the heat exchange medium occurs.

In one general aspect, an integrated heat exchanger includes: a header tank 100 in which a header 110 and a tank 130 are coupled to each other to form a space in which a heat exchange medium is stored and flows, and a gasket 120 is interposed between the header 110 and the tank 130 to seal a portion that the header 110 and the tank 130 are coupled to each other, wherein an inner space of the header tank 100 is partitioned such that first space portions A1 are formed between regions in which the heat exchange medium flows, and a heat exchange medium discharging means is formed at the portion that the header 110 and the tank 130 are coupled to each other so that the first space portions A1 are in communication with an external space A2 of the header tank 100.

The header tank 100 may include the header 110 having a gasket seating groove 111 formed in an edge portion thereof; the gasket 120 having a circumference portion 121 inserted into the gasket seating groove 111 and having both ends of a pair of bridges 122 spaced apart from each other in a length direction and connected to the circumference portion 121; the tank 130 having a coupling portion 131 formed on an opened end portion thereof which is in close contact with the circumference portion 121 of the gasket 120, and coupled to the header 110 to form a space through which the heat exchange medium flows; and a pair of baffles 140 formed inside the tank 130 to be spaced apart from each other in the length direction, and that is in close contact with the pair of bridges 122 of the gasket 120 to partition the inner space formed by the coupling between the header 110 and the tank 130, and the first space A1 between the pair of baffles 140 and the external space A2 of the header tank 100 may be in communication with each other through a gap G between the gasket seating groove 111 of the header 110 and the coupling portion 131 of the tank 130.

A pair of header tanks 100 may be disposed to be spaced apart from each other, and the integrated heat exchanger may further include a plurality of refrigerant tubes 200 having both ends fixed to the pair of header tanks 100 to form a flow path of the heat exchange medium; and a plurality of fins 300 interposed and coupled between the refrigerant tubes 200.

The positions in the length direction of the pair of baffles 140 formed in the header tank 100 disposed at an upper portion and the positions in the length direction of the pair of baffles 140 formed in the header tank 100 disposed at a lower portion may be formed at the same position as each other.

A first heat exchange portion 1000-1 may be formed on one side in the length direction and a second heat exchange portion 1000-2 may be formed on the other side in the length direction with respect to the positions at which the pair of baffles 140 are formed, and the first heat exchange portion 1000-1 and the second heat exchange portion 1000-2 may be provided with an inlet pipe and an outlet pipe, respectively, such that different heat exchange mediums flow in the first heat exchange portion 1000-1 and the second heat exchange portion 1000-2.

The integrated heat exchanger 1000 may further include dummy tubes 400 disposed between the refrigerant tubes 200 and having both ends connected to the pair of header tanks 100 and connected to the first space A1 between the pair of baffles 140.

The dummy tubes 400 may be formed so that the heat exchange medium does not flow therein.

The dummy tubes 400 may be formed in the form of a pipe having both ends closed.

The dummy tubes 400 may be formed in the same form as the refrigerant tubes 200.

The gasket 120 may have a cutout portion 124 in which a portion of the circumference portion 121 is removed at a position between the pair of baffles 140.

The gasket 120 has a connecting portion 123 connecting the pair of bridges 122 at a position of the circumference portion 121 spaced inwardly in the width direction.

The cutout portions 124 may be formed in both sides of the circumference portion 121 in the width direction.

The gasket 120 may have connecting portions 123 connecting the pair of bridges 122 which are each formed at positions of the circumference portion 121 spaced inwardly in the width direction.

The gasket 120 may include a first gasket portion 120-1 sealing one side region of the header tank 100 in which the heat exchange medium flows with respect to the first space portion A1, a second gasket portion 120-2 sealing the other side region of the header tank 100 in which the heat exchange medium flows with respect to the first space portion A1, and a connecting portion 123 connecting the first gasket portion 120-1 and the second gasket portion 120-2 to each other.

The connecting portion 123 may have a cross-sectional area smaller than that of the circumference portion 121 of the first gasket portion 120-1 and the second gasket portion 120-2.

The connecting portion 123 may have a diameter smaller than that of the circumference portion 121 of the first gasket portion 120-1 and the second gasket portion 120-2.

The gasket 120 may have the first gasket portion 120-1, the second gasket portion 120-2, and the connecting portion 123 which are integrally formed.

The baffle 140 may be formed integrally with the tank 130.

| [Detailed Description of Main Elements] | |
|---|---|
| 1000: integrated heat exchanger | |
| 1000-1: first heat exchange portion | 1000-2: second heat exchange portion |
| 100: header tank | |
| 110: header | 111: gasket seating groove |
| 112: tube insertion hole | 113: deformed portion |
| 120: gasket | |
| 120-1: first gasket portion | 120-2: second gasket portion |
| 121: circumference portion | 122: bridge |
| 123: connecting portion | 124: cutout portion |
| 130: tank | 131: coupling portion |
| 140: baffle | |
| 150: inlet pipe | 160: outlet pipe |
| A1: first space | A2: external space |
| G: gap | |
| 200: refrigerant tube | |
| 300: fin | |
| 400: dummy tube | |

DETAILED DESCRIPTION OF EMBODIMENTS

Hereinafter, an integrated heat exchanger according to the present invention having the configuration as described above will be described in detail with reference to the accompanying drawings.

Figure 1:
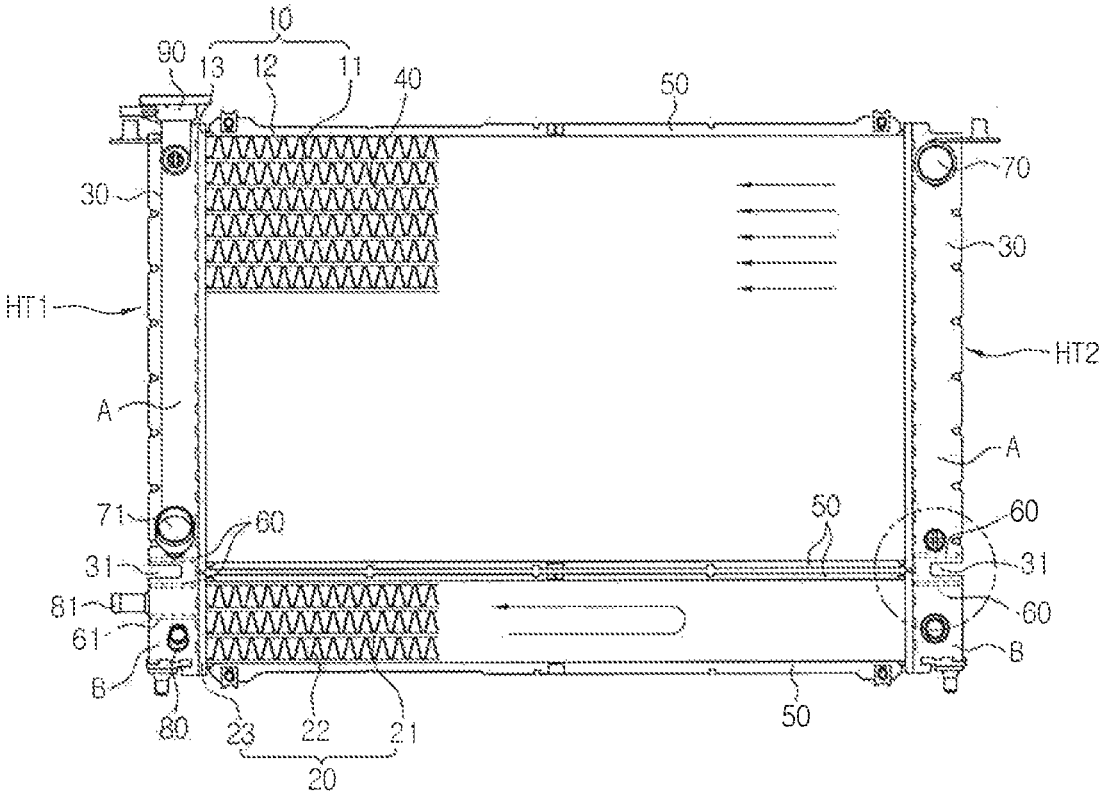
FIG. 1 PRIOR ART
FIG. 1 is a view illustrating a heat exchanger according to the related art.
Figure 2:
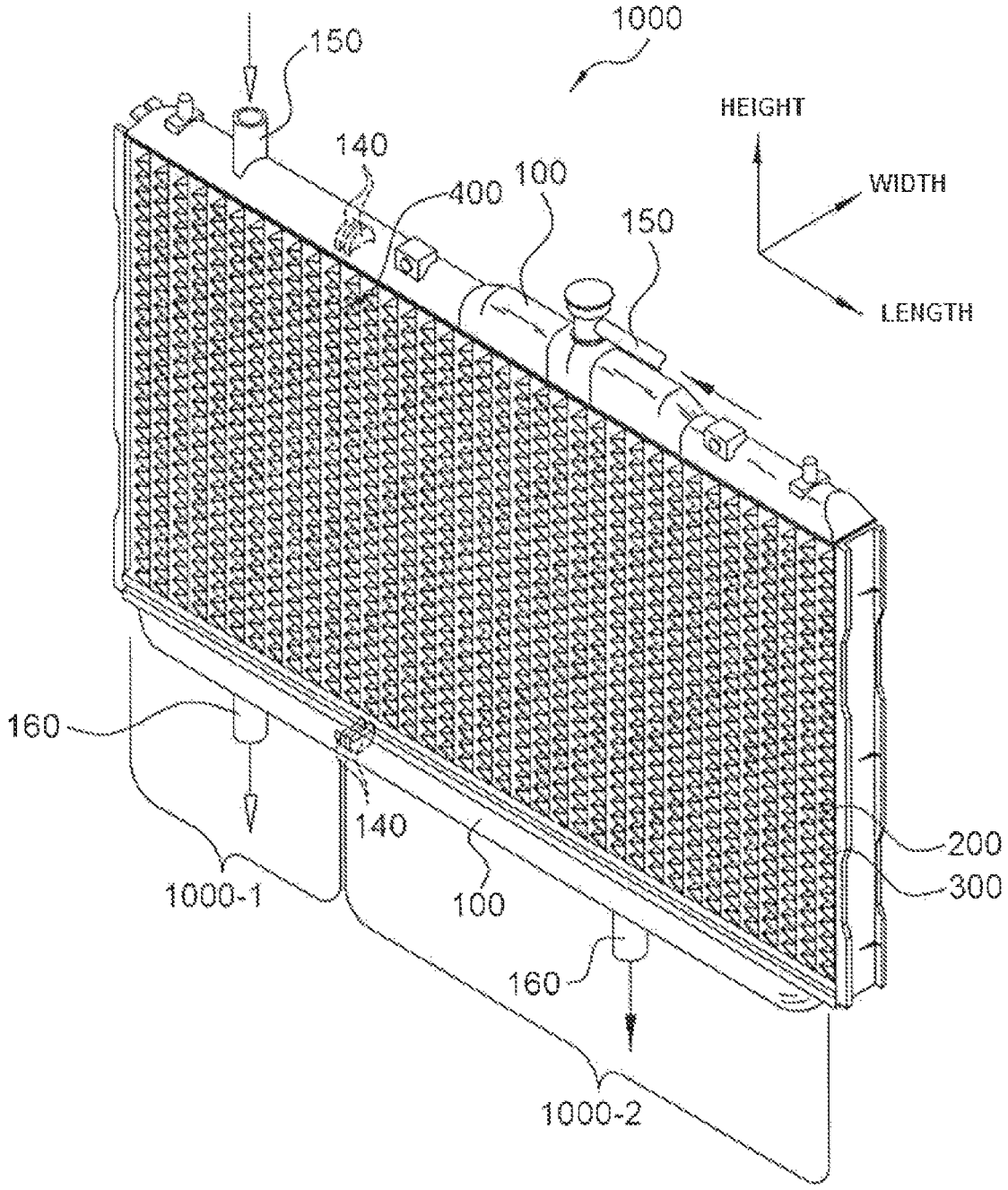
FIGS. 2 and 3 are an assembled perspective view and an exploded perspective view illustrating an integrated heat exchanger according to an exemplary embodiment of the present invention.
Figure 3:
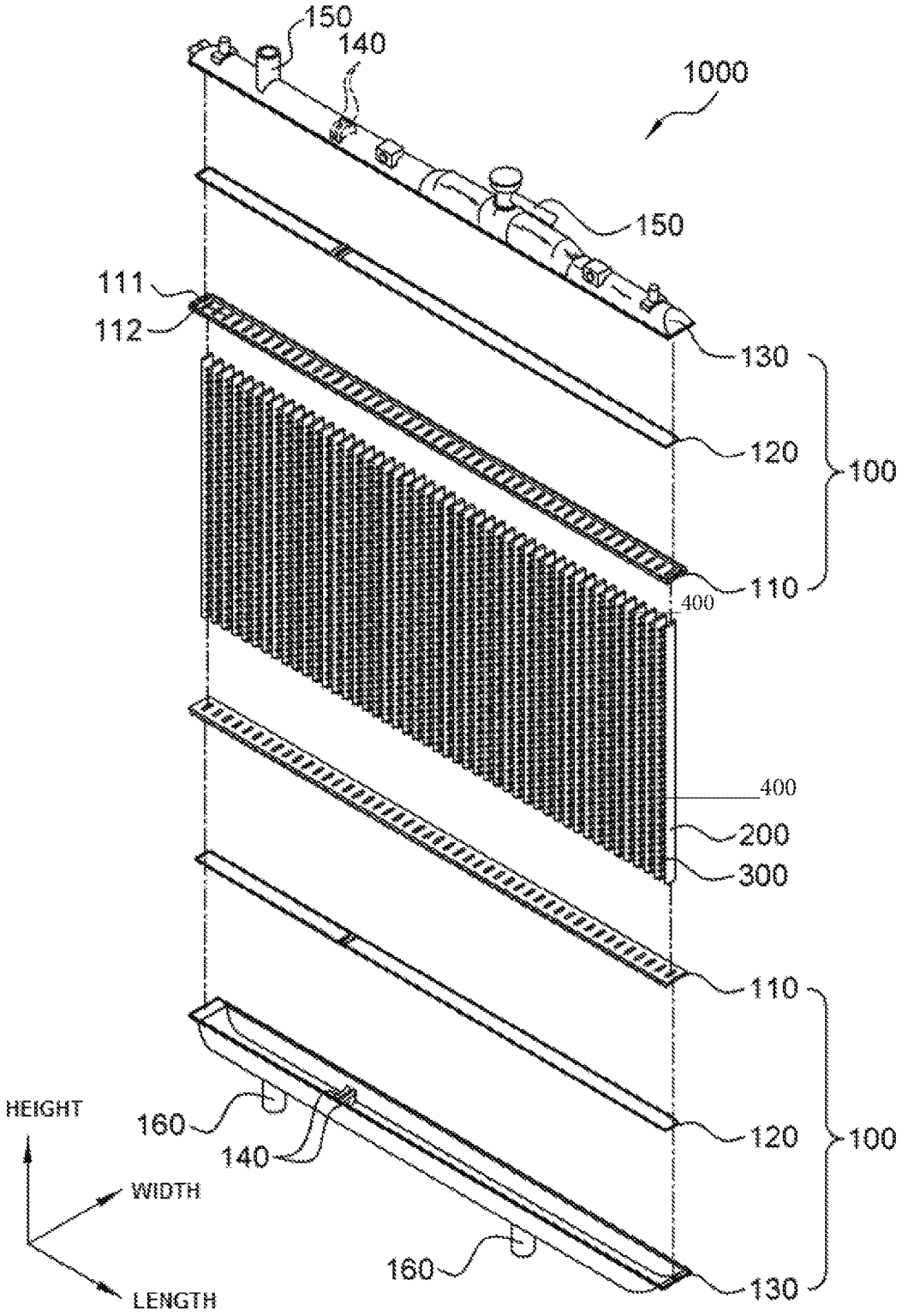
Figure 4:
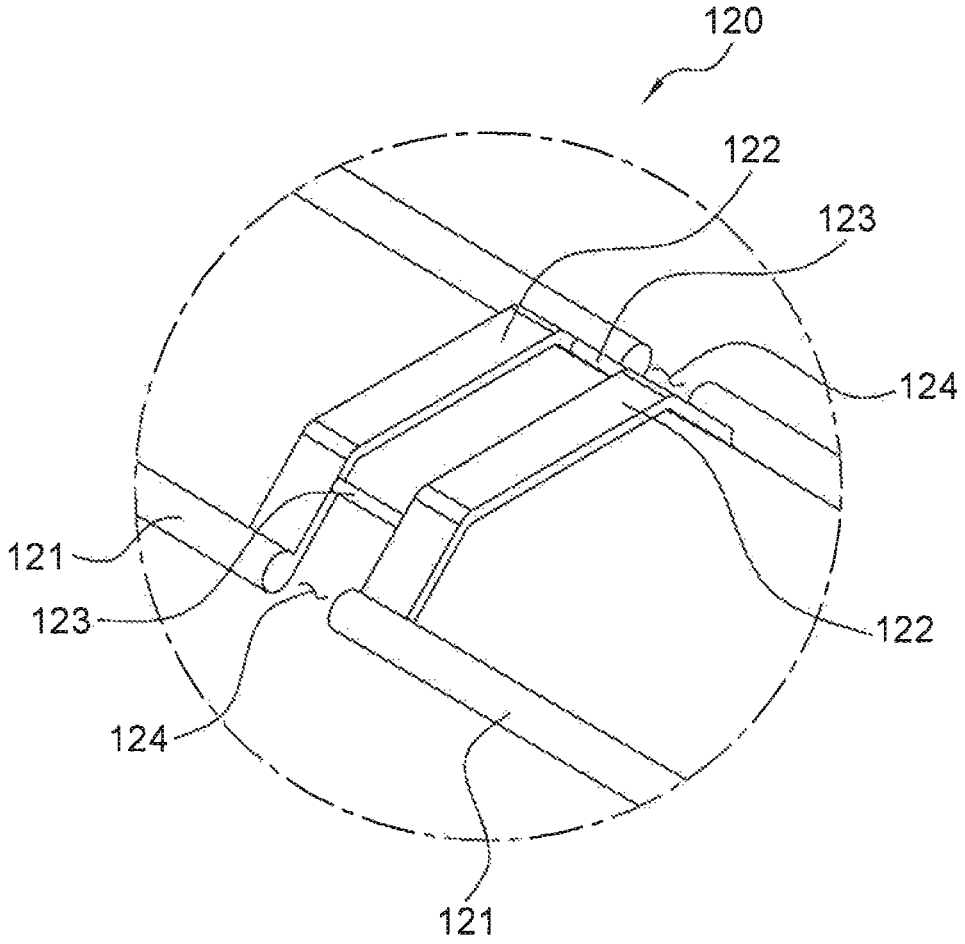
FIG. 4 is a partial perspective view illustrating a gasket according to the present invention.
Figure 5:
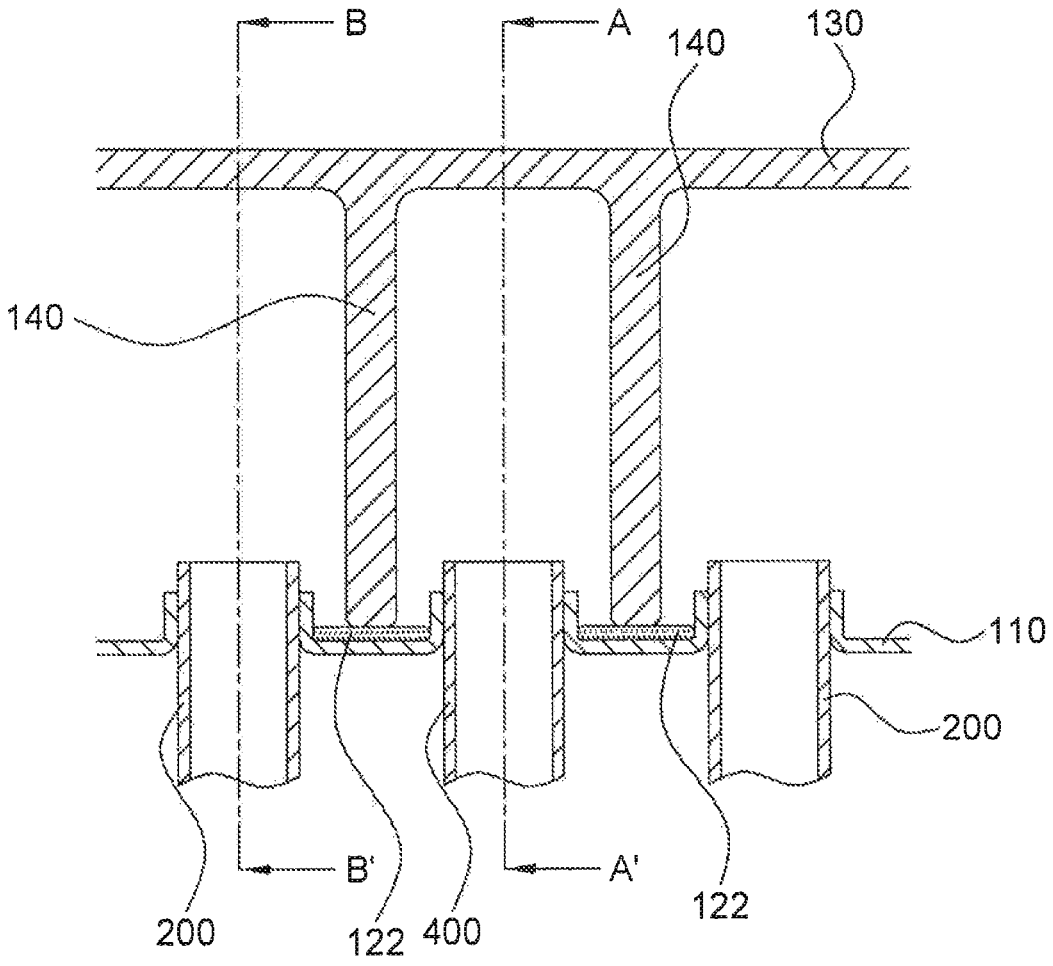
FIG. 5 is a front cross-sectional view illustrating a portion at which a baffle is positioned in a header tank according to the present invention.
Figure 6:
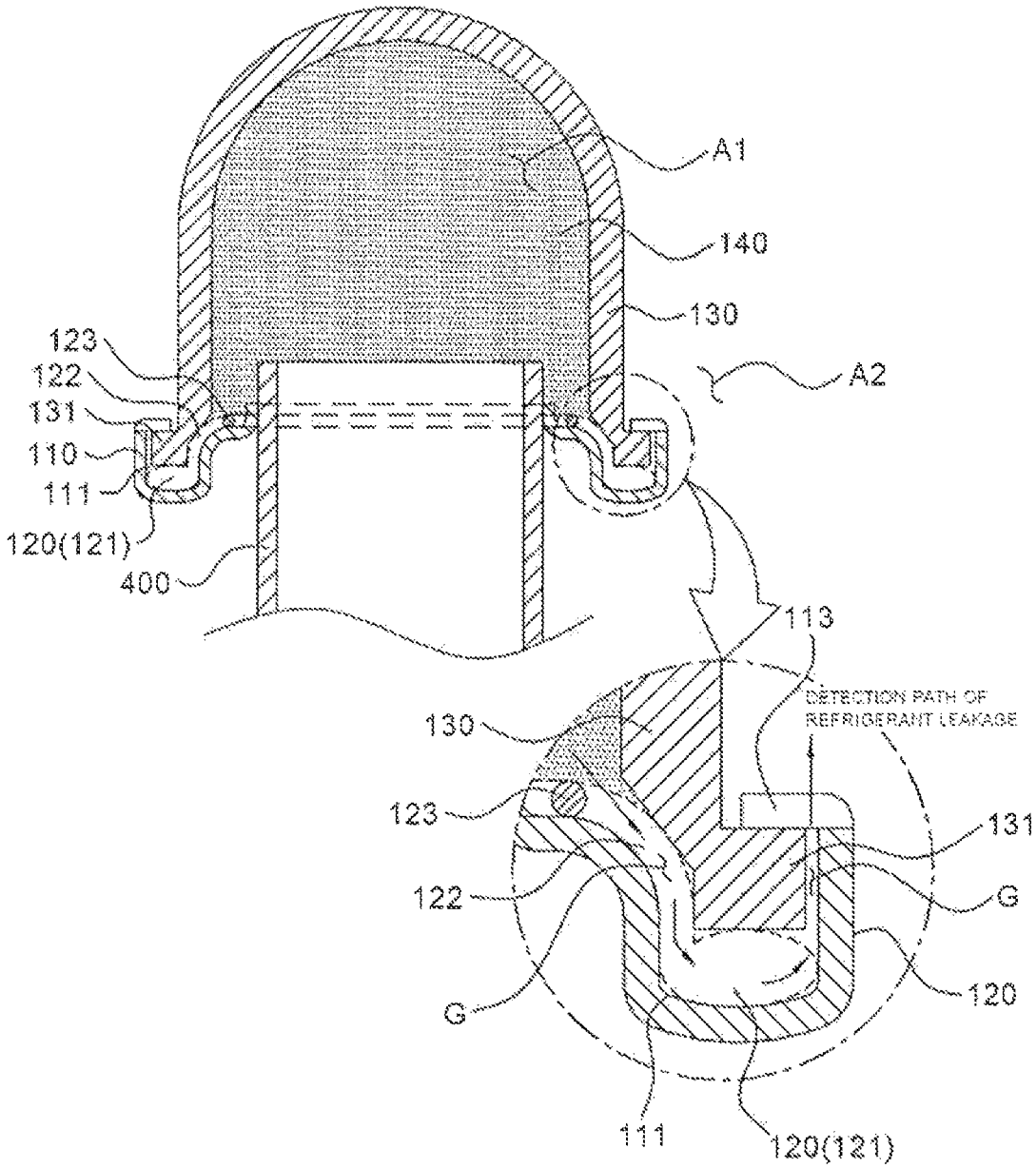
FIG. 6 is a cross-sectional view taken along a direction A-A' of FIG. 5.
Figure 7:
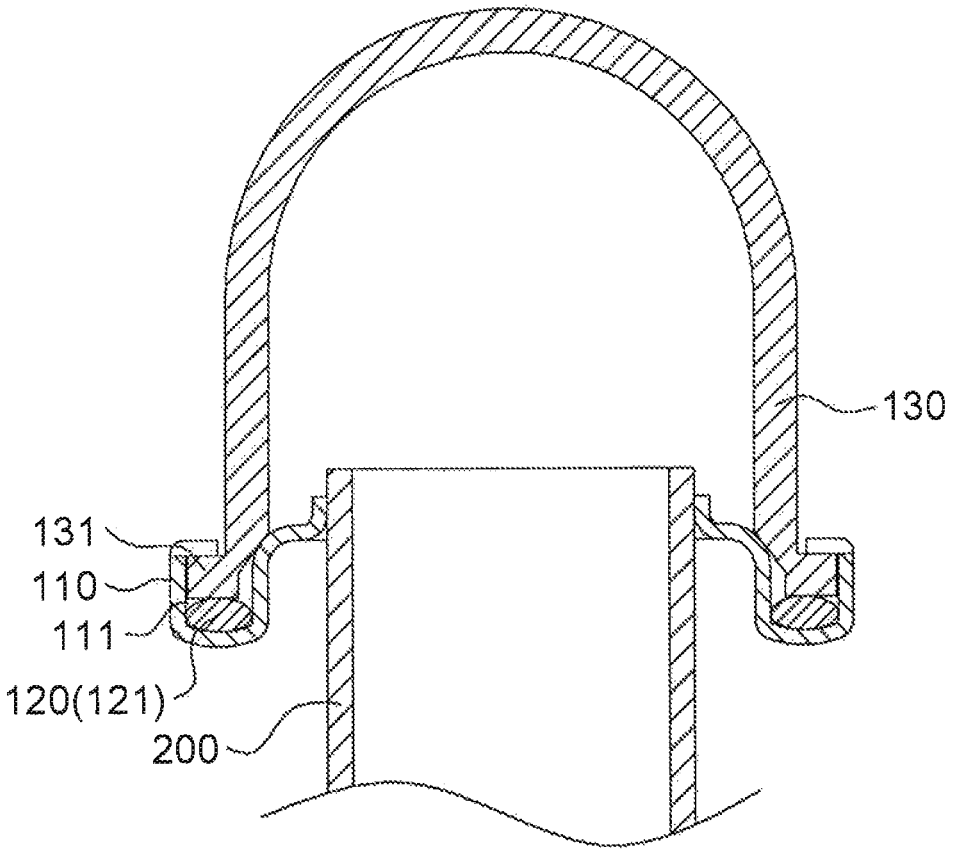
FIG. 7 is a cross-sectional view taken along a direction B-B' of FIG. 5.

FIGS. 2 and 3 are an assembled perspective view and an exploded perspective view illustrating an integrated heat exchanger according to an exemplary embodiment of the present invention, FIG. 4 is a partial perspective view illustrating a gasket according to the present invention, FIG. 5 is a front cross-sectional view illustrating a portion at which a baffle is positioned in a header tank according to the present invention, and FIGS. 6 and 7 are cross-sectional views taken along a direction A-A' of FIG. 5 and a cross-sectional view taken along a direction B-B' of FIG. 5.

As illustrated, an integrated heat exchanger 1000 according to an exemplary embodiment of the present invention includes a header tank 100 in which a header 110 and a tank 130 are coupled to each other to form a space in which a heat exchange medium may be stored and flow, and a gasket 120 is interposed between the header 110 and the tank 130 to seal a portion that the header 110 and the tank 130 are coupled to each other, wherein an inner space of the header tank 100 may be partitioned such that first space portions A1 are formed between regions in which the heat exchange medium flows, and a heat exchange medium discharging means may be formed at the portion that the header 110 and the tank 130 are coupled to each other so that the first space portions A1 are in communication with an external space A2 of the header tank 100.

First, the integrated heat exchanger 1000 according to the present invention may generally include a pair of header tanks 100, a plurality of refrigerant tubes 200, and a plurality of fins 300.

The header tanks 100 may form a flow path through which a heat exchange medium flows, and may be disposed side by side to be spaced apart from each other by a predetermined distance in a height direction. In addition, the header tank 100 may be formed by a coupling between the header 110 and the tank 130, and a gasket 120, which is a sealing member, is interposed in a portion that the header 110 and the tank 130 are coupled to each other, such that the header 110 and the tank 130 may coupled to each other to prevent the leakage of the heat exchange medium. In addition, inlet pipes 150 into which the heat exchange medium is introduced and outlet pipes 160 through which the heat exchanger medium is discharged may be formed in the header tanks 100, respectively.

The refrigerant tubes 200 are inserted into tube insertion holes 112 formed in the headers 110 of the header tanks 100 and both ends thereof are then fixed by blazing or the like to form heat exchange medium flow paths. The heat exchange medium passes through the refrigerant tubes 200 in which heat exchange occurs. Here, a plurality of tube insertion holes 112 are formed in the header 110 so that the end portions of the refrigerant tubes 200 may be inserted thereinto. The plurality of tube insertion holes 112 are formed side by side to be spaced apart from each other by a predetermined distance in a length direction, such that the plurality of refrigerant tubes 200 may be disposed side by side to be spaced apart from each other in the length direction.

The fins 300 may be interposed between the refrigerant tubes 200 and may be coupled to the refrigerant tubes 200 by blazing or the like in a state in which they are disposed to be in contact with the refrigerant tubes 200. The fins 300 are formed in a corrugated shape to serve to increase a heat radiating area of the heat exchange medium passing through the refrigerant tubes 200 to increase heat exchange efficiency.

Here, the headers 110 and the tanks 130 of the header tanks 100 according to the present invention are coupled to each other to form spaces in which the heat exchange medium may be stored and flow. In this case, the gaskets 120 are interposed between the headers 110 and the tanks 130 and the headers 110 and the tanks 130 are then coupled to each other, such that the portions that the headers 110 and the tanks 130 are coupled to each other may be sealed. An inner space of the header tank 100 may be partitioned by a baffle 140 or the like such that first space portions A1, which are empty spaces, are formed between regions in which the heat exchange medium flows, and the regions in which different heat exchange mediums may flow may be formed on one side and the other side of the first space portion A1 so as to be sealed. In addition, a heat exchange medium discharging means may be formed in the portion that the header 110 and the tank 130 are coupled to each other so as to be in communication with the external space A2, which is an outer space of the first space portion A1 and the header tank 100. In this case, the heat exchange medium discharging means may be for example, a flow path through which the heat exchange medium may pass, and may be variously formed in addition to this.

Therefore, the integrated heat exchanger according to the present invention may detect that the heat exchange medium is leaked between the two heat exchange portions through the heat exchange medium discharging means. In this case, since a separate hole for detecting the leakage of the heat exchange medium is not formed in the header or the tank and it is difficult for external foreign materials or the like to be introduced through the heat exchange medium discharging means, which is a passage through which the leakage of the heat exchange medium may be detected, it is possible to prevent corrosion by foreign materials in the portion between the two heat exchange portions.

In addition, the pair of header tanks 100 includes the headers 110 having gasket seating grooves 111 formed in edge portions thereof; the gaskets 120 having circumference portions 121 inserted into the gasket seating grooves 111 and having both ends of a pair of bridges 122 spaced apart from each other in the length direction and connected to the circumference portions 121; the tanks 130 having coupling portions 131 formed on opened end portions thereof which are in close contact with the circumference portions 121 of the gaskets 120, and coupled to the headers 110 to form spaces through which the heat exchange medium flows; and a pair of baffles 140 formed inside the tanks 130 to be spaced apart from each other in the length direction, and that is in close contact with the pair of bridges 122 of the gaskets 120 to partition the inner spaces formed by the coupling between the headers 110 and the tanks 130, wherein the first spaces A1 between the pair of baffles 140 and the external space A2 of the header tanks 100 may be configured to be in communication with each other through gaps G between the gasket seating grooves 111 of the headers 110 and the coupling portions 131 of the tanks 130.

Here, the headers 110 are provided with the gasket seating grooves 111 so that the gaskets 120 may be insertedly disposed in the edge portions thereof, and the gasket seating grooves 111 may be concavely formed along the entirety of circumferences of the headers 110.

The gaskets 120 may have the circumference portions 121 formed in the form corresponding to the form of the gasket seating grooves 111 formed in the headers 110. In addition, the gaskets 120 may have the pair of bridges 122 connected to both sides of the circumference portions 121 in the width direction, and the pair of bridges 122 may be disposed to be spaced apart from each other in the length direction. As a result, the circumference portions 121 of the gaskets 120 may be insertedly disposed in the gasket seating grooves 111, and the bridges 122 are disposed at both sides of one tube insertion hole 112 formed in the header 110, respectively. Therefore, the bridges 122 may be disposed between the tube insertion holes 112.

The tanks 130 are coupled to the headers 110 to form the spaces in which the heat exchange medium may be stored and flow. The tanks 130 are formed in the form of a concave container having an opened one side, and the tanks 130 have the coupling portions 131 formed along the circumference thereof at the opened end thereof such that the coupling portions 131 may be inserted into the gaskets seating grooves 111 of the headers 110. As a result, the circumference portions 121 of the gaskets 120 are inserted into the gasket seating grooves 111 of the header 110, and the bridges 122 are put on upper surfaces of the headers 110.

In this case, the baffles 140 are formed inside the tanks 130 so as to partition the inner spaces of the tanks 130 and may be formed at positions corresponding to the bridges 122 of the gaskets 120. That is, the baffles 140 may be configured in a pair and disposed to be spaced apart from each other in the length direction. In addition, the baffles 140 may be formed integrally with the tanks 130.

In addition, the positions of the pair of baffles 140 formed in the header tank 100 disposed at an upper portion and the positions of the pair of baffles 140 formed in the header tank 100 disposed at a lower portion may be formed at the same position as each other in the length direction.

As a result, the coupling portions 131 of the tanks 130 are insertedly coupled to the gasket seating grooves 111 of the headers 110 in a state in which the gaskets 120 are coupled to the headers 110, and deformed portions 113 extending upwardly from the outside of the gasket seating grooves 111 are bent toward the tanks 130 in a state in which the headers 110 and the tanks 130 are pressed. Therefore, in a state in which the circumference portions 121 of the gaskets 120 are pressed by the headers 110 and the tanks 130 to be in close contact with the headers 110 and the tanks 130, and the bridges 122 of the gaskets 120 are pressed by the headers 110 and the baffles 140 to be in close contact with the headers 110 and the baffles 140, the circumference portions 121 of the gaskets 120 may be coupled to the headers 110 and the tanks 130 and the bridges 122 of the gaskets 120 may be coupled to the headers 110 and the baffles 140.

Accordingly, the inner spaces of the header tanks 100 are partitioned by the pair of baffles 140, and a first heat exchange portion 1000-1 may be formed on the left side in the length direction and a second heat exchange portion 1000-2 may be formed on the right side in the length direction with respect to the position at which the pair of baffles 140 are formed. In addition, the first heat exchange portion 1000-1 and the second heat exchange portion 1000-2 are provided with an inlet pipe and an outlet pipe, respectively, such that different heat exchange mediums may flow in the first heat exchange portion 1000-1 and the second heat exchange portion 1000-2.

Here, the first space A1, which is the empty space between the pair of baffles 140 of the header 100, is in communication with the external space A2 of the header tank 100. As illustrated, the first space A1 and the external space A2 may be configured to be in communication with each other through the gap G between the gasket seating groove 111 of the header 110 and the coupling portion 131 of the tank 130.

Therefore, the integrated heat exchanger according to the present invention may detect that the heat exchange medium is leaked between the two heat exchange portions. In this case, since a separate hole for detecting the leakage of the heat exchange medium is not formed in the header or the tank and it is difficult for external foreign materials or the like to be introduced through the gap, which is a passage through which the leakage of the heat exchange medium may be detected, it is possible to prevent corrosion by foreign materials in the portion between the two heat exchange portions.

In addition, the integrated heat exchanger 1000 may further include dummy tubes 400 disposed between the refrigerant tubes 200 and having both ends connected to the pair of header tanks 100 and connected to the first space A1 between the pair of baffles 140.

That is, as illustrated, the dummy tubes 400 may be disposed at positions between the pair of baffles 140 in the length direction, and an upper end of the dummy tube 400 may be connected to the first space A1 of the header tank 100 disposed at the upper portion and a lower end thereof may be connected to the first space A1 of the header tank 100 disposed at the lower portion. In this case, the dummy tube 400 is formed in the form of a pipe in which an inner portion thereof is empty and both ends are opened and serves to block a heat transfer between the two heat exchange portions when heat exchange mediums having different temperatures flow through the first heat exchange portion 1000-1 and the second heat exchange portion 1000-2.

In addition, the dummy tubes 400 may be formed so that the heat exchange medium does not flow therein. That is, both ends of the dummy tubes 400 are connected to the first space A1 between the baffles 140 such that the heat exchange medium may be introduced into the dummy tubes 400 or may not flow along the dummy tubes 400. However, in a case in which the leakage of the heat exchange medium occurs toward the first space A1 in the header tank of the first heat exchange portion 1000-1 or the second heat exchange portion 1000-2 and the heat exchange medium is introduced into the first space A1, the heat exchange medium may be introduced into the dummy tubes 400 or may flow along the dummy tubes 400. Therefore, for example, the dummy tubes 400 are formed in the form of a pipe having both ends closed so that the heat exchange medium may not flow in the dummy tubes 400. In this case, after the dummy tubes 400 having both ends opened are insertedly assembled to the tube insertion holes 112 of the header 110, both ends of the dummy tubes 400 are closed by compression or caulking, thereby making it possible to prevent the heat exchange medium from being introduced into the dummy tubes 400.

In addition, the dummy tubes 400 may be formed in the same form as the refrigerant tubes 200. That is, the refrigerant tubes 200 may be formed in the form of the pipe in which both ends thereof are opened so that the heat exchange medium flows. Therefore, in the case in which the dummy tubes 400 are formed in the same form as the refrigerant tubes 200, since the refrigerant tubes 200 and the dummy tubes 400 may be commonly used, the refrigerant tube 200 and the dummy tube 400 may be used without distinguishing therebetween by using the same type of tube. In this case, the refrigerant tubes 200 may be disposed on the first heat exchange portion 1000-1 and the second heat exchange portion 1000-2, and the dummy tubes 400 may be disposed on positions between the pair of baffles 140 in the length direction.

In addition, the gasket 120 may have a cutout portion 124 in which a portion of the circumference portion 121 is removed at a position between the pair of baffles 140.

That is, as illustrated, in the form in which the entirety of the circumference portion 121 is connected in the form corresponding to a trajectory of the gasket seating groove 111 of the header 110, the circumference portion 121 of the gasket 120 may be provided with the cutout portion 124 in which the position between the pair of baffles 140 in the length direction is disconnected. As a result, the cutout portion 124 of the gasket 120 forms an empty space together with the gasket seating groove 111 of the header 110 and the coupling portion 131 of the tank 130. Therefore, when the leakage of the heat exchange medium toward the first space A1 occurs, it is possible to easily detect the leakage of the heat exchange medium through the gap G between the cutout portion 124, and the gasket seating groove 111 of the header 110 and the coupling portion 131 of the tank 130.

In this case, the gasket 120 may have a connecting portion 123 connecting the pair of bridges 122 at a position of the circumference portion 121 spaced inwardly in the width direction. That is, as illustrated, when the cutout portion 124 is formed in the circumference portion 121 of the gasket 120 as illustrated, an interval between the pair of bridges 122 may not be accurately maintained. Therefore, the connecting portion 123 connecting between the pair of bridges 122 is formed at the position of the circumference portion 121 spaced inwardly in the width direction, thereby making it possible to easily maintain the form of the gasket 120 by the connecting portion 123.

In addition, the cutout portions 124 may be formed in both sides of the circumference portion 121 in the width direction.

That is, the cutout portions 124 of the gasket 120 are each formed in portions positioned at both sides of the circumference portion 121 in the width direction, thereby making it possible to easily detect the leakage of the heat exchange medium in both sides of the header tank 100 in the width direction.

In this case, the connecting portions 123 of the gasket 120 may be each formed at the positions of the cutout portions 124 spaced inwardly in the width direction.

In addition, the gasket 120 may include a first gasket portion 120-1 sealing one side region of the header tank 100 in which the heat exchange medium flows with respect to the first space portion A1, a second gasket portion 120-2 sealing the other side region of the header tank 100 in which the heat exchange medium flows with respect to the first space portion A1, and the connecting portions 123 connecting the first gasket portion 120-1 and the second gasket portion 120-2 to each other.

Figure 8:
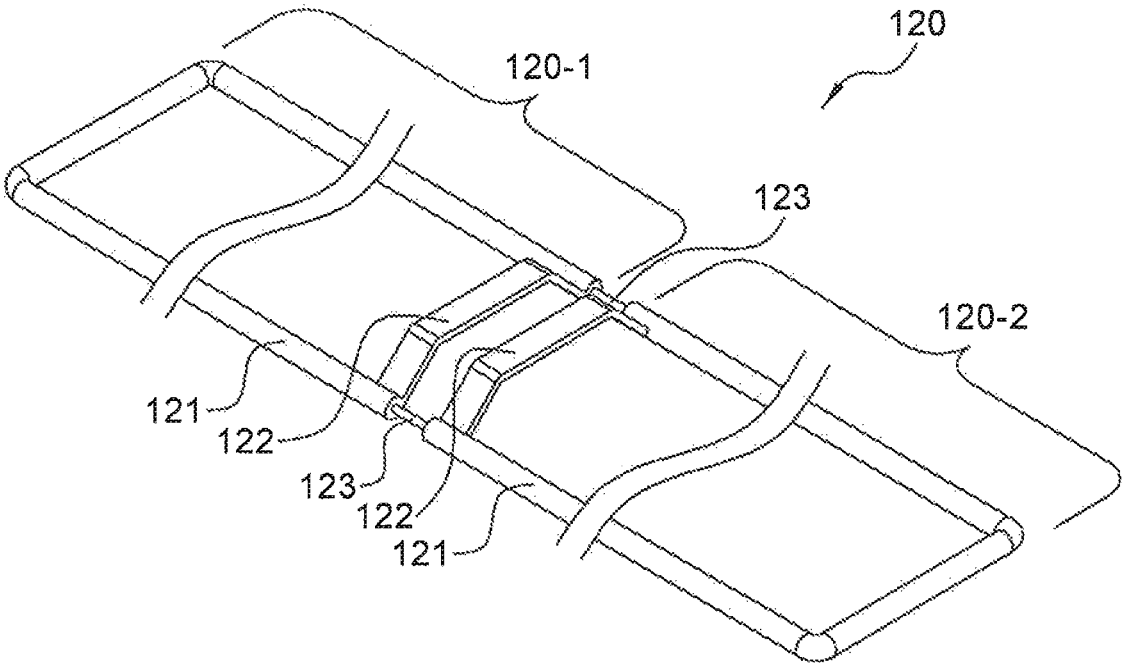
FIG. 8 is a perspective view illustrating another example of the gasket according to the present invention.

That is, as illustrated in FIG. 8, the gasket 120 is formed by separating the first gasket portion 120-1 and the second gasket portion 120-2 in such a manner that the circumference portion 121 and the bridge 122 are connected to each other so as not to be disconnected, and may be formed in the form in which the respective separated first gasket portion 120-1 and second gasket portion 120-2 are connected to each other by the connecting portions 123. Here, the first gasket portion 120-1, the second gasket portion 120-2, and the connecting portion 123 may be integrally formed by injection molding.

In addition, the connecting portion 123 may have a cross-sectional area smaller than that of the circumference portion 121 of the first gasket portion 120-1 and the second gasket portion 120-2.

Figure 9:
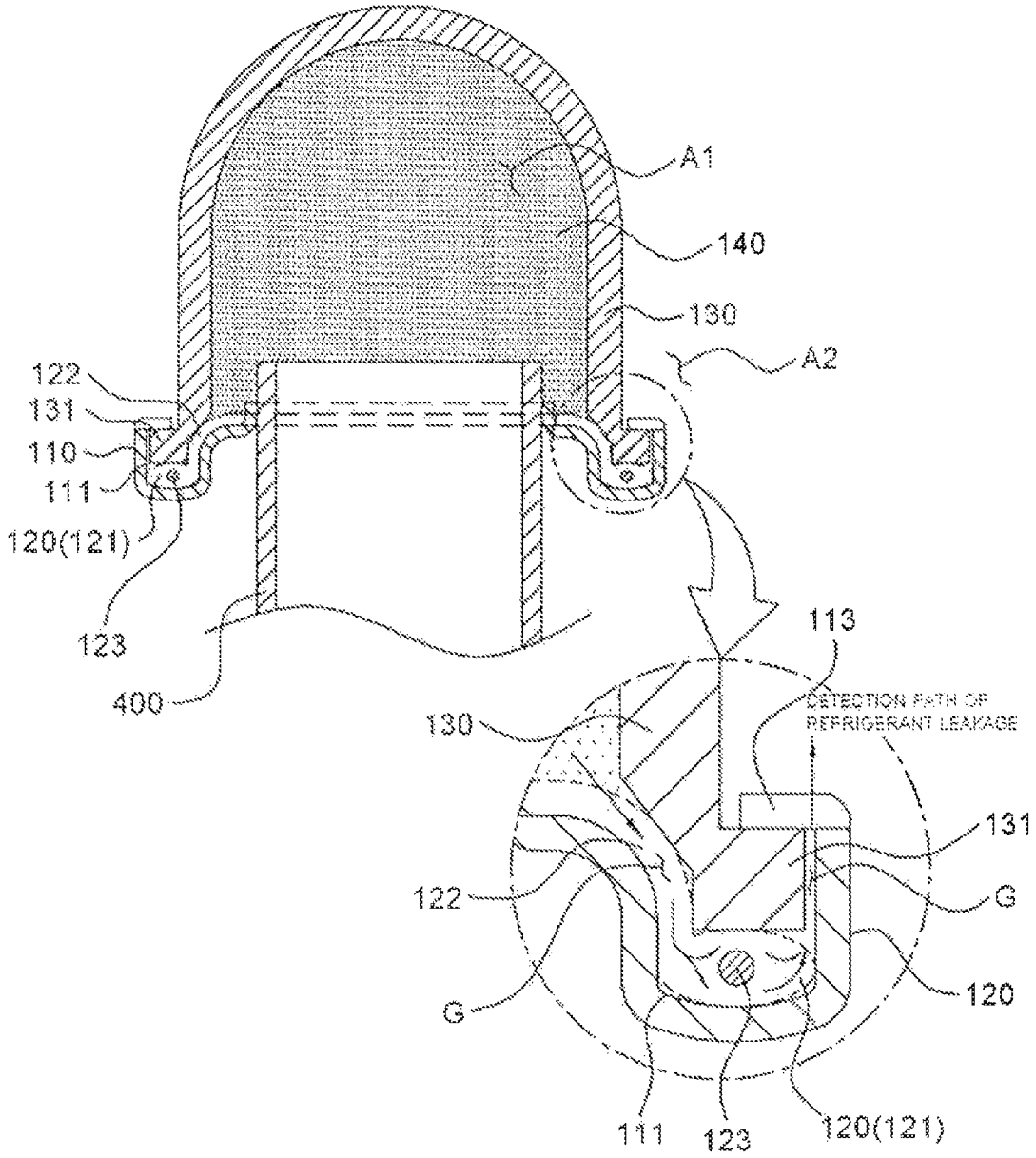
FIG. 9 is a cross-sectional view taken along the direction A-A' in an example in which the gasket of FIG. 8 is installed.

In this case, the connecting portion 123 may have a diameter smaller than that of the circumference portion 121 as illustrated in FIGS. 8 and 9. Therefore, even when the circumference portion 121 of the gasket 120 is pressed by the coupling between the header 110 and the tank 130, portions in which the connecting portions 123 are present are not closed and the gaps through which the heat exchange medium may pass may be formed.

According to the present invention, the integrated heat exchanger may detect the heat exchange mediums leaked between the two heat exchanging parts, and may prevent corrosion by the foreign materials in the portion between the two heat exchanging parts because it is difficult for the external foreign materials to be introduced through a passage through which the leakage of the heat exchange medium may be detected.

The present invention is not limited to the abovementioned exemplary embodiments, but may be variously applied. In addition, the present invention may be variously modified by those skilled in the art to which the present invention pertains without departing from the gist of the present invention claimed in the claims.

What is claimed is:

1. An integrated heat exchanger comprising:

a header tank in which a header and a tank are coupled to each other to form a space in which a heat exchange medium is stored and flows, and a gasket is interposed between the header and the tank to seal a portion that the header and the tank are coupled to each other, wherein an inner space of the header tank is partitioned such that first space portions are formed between regions in which the heat exchange medium flows, and the first space portions are in communication with an external space of the header tank at the portion that the header and the tank are coupled to each other, wherein the header has a gasket seating groove formed in an edge portion thereof;

wherein the gasket has a circumference portion inserted into the gasket seating groove and having both ends of a pair of bridges spaced apart from each other in a length direction and connected to the circumference portion;

wherein the tank has a coupling portion formed on an opened end portion thereof which is in close contact with the circumference portion of the gasket, and coupled to the header to form a space through which the heat exchange medium flows; and a pair of baffles formed inside the tank to be spaced apart from each other in the length direction, and that is in close contact with the pair of bridges of the gasket to partition the inner space formed by the coupling between the header and the tank, and wherein a first space A1 between the pair of baffles and an external space A2 of the header tank is in communication with each other through a gap G between the gasket seating groove of the header and the coupling portion of the tank, wherein the gasket has a cutout portion in which a portion of the circumference portion is removed at a position between the pair of baffles, and wherein the gasket has a connecting portion connecting the pair of bridges to each other to maintain an interval between the pair of bridges at a position of the circumference portion spaced inwardly in the width direction, and wherein the connecting portion is disposed outside the gasket seating groove of the header and the connecting portion is disposed at a position spaced inwardly in the width direction from an inner sidewall of the tank.

2. The integrated heat exchanger of claim 1, wherein the header tanks are configured in a pair and the pair of the header tanks are disposed to be spaced apart from each other, and the integrated heat exchanger further includes:

a plurality of refrigerant tubes having both ends fixed to the pair of header tanks to form a flow path of the heat exchange medium; and a plurality of fins interposed and coupled between the refrigerant tubes.

3. The integrated heat exchanger of claim 2, wherein the pair of header tanks have the pair of baffles partitioning the inner space thereof, respectively, and the positions in the length direction of the pair of baffles formed in the header tank disposed at an upper portion and the positions in the length direction of the pair of baffles formed in the header tank disposed at a lower portion are formed at the same position as each other.

4. The integrated heat exchanger of claim 3, wherein a first heat exchange portion is formed on one side in the length direction and a second heat exchange portion is formed on the other side in the length direction with respect to the positions at which the pair of baffles are formed, and wherein the first heat exchange portion and the second heat exchange portion are provided with an inlet pipe and an outlet pipe, respectively.

5. The integrated heat exchanger of claim 2, further comprising a dummy tube disposed between the refrigerant tubes and having both ends connected to the pair of header tanks and connected to the first space between the pair of baffles.

6. The integrated heat exchanger of claim 5, wherein the dummy tube is formed so that the heat exchange medium does not flow therein.

7. The integrated heat exchanger of claim 6, wherein the dummy tube is formed in the form of a pipe having both ends closed.

8. The integrated heat exchanger of claim 5, wherein the dummy tube is formed in the same shape as the refrigerant tubes.

9. The integrated heat exchanger of claim 1, wherein cutout portions are formed in both sides of the circumference portion in the width direction, respectively.

10. The integrated heat exchanger of claim 9, wherein the gasket has connecting portions connecting the pair of bridges which are each formed at positions of the circumference portion spaced inwardly in the width direction.

11. The integrated heat exchanger of claim 1, wherein the gasket includes a first gasket portion sealing one side region of the header tank in which the heat exchange medium flows with respect to the first space portion, a second gasket portion sealing the other side region of the header tank in which the heat exchange medium flows with respect to the first space portion, and a connecting portion connecting the first gasket portion and the second gasket portion to each other.

12. The integrated heat exchanger of claim 11, wherein the connecting portion has a cross-sectional area smaller than that of the circumference portion of the first gasket portion and the second gasket portion.

13. The integrated heat exchanger of claim 12, wherein when the gasket is yet to be pressed, the connecting portion has a diameter smaller than that of the circumference portion of the first gasket portion and the second gasket portion.

14. The integrated heat exchanger of claim 11, wherein the gasket has the first gasket portion, the second gasket portion, and the connecting portion which are integrally formed.

15. The integrated heat exchanger of claim 1, wherein the pair of baffles are formed integrally with the tank.

* * * * *